US011258199B2

(12) United States Patent
Baek et al.

(10) Patent No.: US 11,258,199 B2
(45) Date of Patent: Feb. 22, 2022

(54) CONNECTOR AND CONNECTOR ASSEMBLY COMPRISING THE SAME

(71) Applicant: APTIV TECHNOLOGIES LIMITED, St. Michael (BB)

(72) Inventors: Hyun Chul Baek, Hwaseong-si (KR); Jae Yup Jung, Pyeongtaek-si (KR); Ju Won Seo, Incheon (KR); Do Hyeoung Kim, Hwaseong-si (KR); Joo Hyun Park, Osan-si (KR)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/995,532

(22) Filed: Aug. 17, 2020

(65) Prior Publication Data

US 2021/0057848 A1 Feb. 25, 2021

(30) Foreign Application Priority Data

Aug. 19, 2019 (KR) ..... 10-2019-0101067

(51) Int. Cl.
*H01R 13/627* (2006.01)
*H01R 13/631* (2006.01)

(52) U.S. Cl.
CPC ..... *H01R 13/6272* (2013.01); *H01R 13/631* (2013.01)

(58) Field of Classification Search
CPC . H01R 13/6272; H01R 13/631; H01R 13/627
See application file for complete search history.

(56) References Cited

U.S. PATENT DOCUMENTS 4,894,019 A * 1/1990 Howard ..... H01H 13/12 200/51.09
4,993,967 A * 2/1991 Matsumoto ..... H01R 13/6272 439/352
5,370,543 A * 12/1994 Hamada ..... H01R 13/641 439/188
5,476,391 A * 12/1995 Katsuma ..... H01R 13/62933 439/155
5,618,201 A * 4/1997 Yagi ..... H01R 13/641 439/489

(Continued)

FOREIGN PATENT DOCUMENTS

JP H06151006 A 5/1994
JP 2009245892 A 10/2009

(Continued)

OTHER PUBLICATIONS

Notice of Allowance for Korean Application No. 1020190101067, dated Jan. 18, 2021 5 pages.

*Primary Examiner* — Abdullah A Riyami
*Assistant Examiner* — Nader J Alhawamdeh
(74) *Attorney, Agent, or Firm* — Billion & Armitage

(57) ABSTRACT

A connector is provided. The connector includes a connector body formed with a terminal portion, a locking body slidably coupled to the connector body, and a spring including a first leg portion fixed in position inside the connector body and a second leg portion making contact with the locking body. The spring is configured to apply a restoring force to the locking body in a direction in which the second leg portion is moved away from the first leg portion.

15 Claims, 17 Drawing Sheets

(56) References Cited

U.S. PATENT DOCUMENTS 5,820,400 A * 10/1998 Yamanashi ..... H01R 13/6272 439/358
5,827,086 A * 10/1998 Fukuda ..... H01R 13/6272 439/357
5,938,466 A * 8/1999 Suzuki ..... H01R 13/635 439/352
6,102,726 A * 8/2000 Tsuji ..... H01R 13/6272 439/352
6,106,321 A * 8/2000 Yoshida ..... H01R 13/6272 439/310
6,341,973 B1 * 1/2002 Endo ..... H01R 13/6272 439/350
6,368,140 B2 * 4/2002 Torii ..... H01R 13/6271 439/352
6,428,346 B1 * 8/2002 Torii ..... H01R 13/641 439/354
6,488,524 B2 * 12/2002 Endo ..... H01R 13/6272 439/353
6,497,584 B1 * 12/2002 Murakami ..... H01R 13/641 439/352
6,497,585 B2 * 12/2002 Torii ..... H01R 13/641 439/352
6,835,076 B2 * 12/2004 Jones ..... B60N 2/0224 439/137
7,052,171 B1 * 5/2006 Lefebvre ..... F21K 9/27 362/649
9,590,354 B2 * 3/2017 Kobayashi ..... H01R 13/6273
10,784,619 B2 * 9/2020 Ochiai ..... H01R 13/5219
2004/0110402 A1 * 6/2004 Jones ..... H01R 13/6315 439/137
2008/0124966 A1 * 5/2008 Lim ..... H01R 13/641 439/357
2009/0017656 A1 * 1/2009 Lee ..... H01R 13/4538 439/144
2019/0288452 A1 * 9/2019 Lord ..... H01R 13/641
2020/0076125 A1 * 3/2020 Lim ..... H01R 13/6272
2021/0057848 A1 * 2/2021 Baek ..... H01R 13/64

FOREIGN PATENT DOCUMENTS

KR 101996002966 A1 1/1996
KR 20080046566 A 5/2008

* cited by examiner

CONNECTOR AND CONNECTOR ASSEMBLY COMPRISING THE SAME

CROSS-REFERENCE TO RELATED APPLICATIONS

This application claims the benefit of Korean Patent Application No. 10-2019-0101067, filed on Aug. 19, 2019, in the Korean Intellectual Property Office, the disclosure of which is incorporated herein in its entirety by reference.

TECHNICAL FIELD

The present disclosure relates to a connector and a connector assembly comprising the same.

BACKGROUND

A connector refers to a connection component that is used to electrically connect one circuit and another circuit. Connectors are used to connect cables or wires in motor vehicles. The connectors connected for such purposes are used by being clipped to be fixed to a vehicle body so as not to interfere with other components of the motor vehicle.

As such, the connectors are connection members that serve as a medium for interconnecting wirings and the like used in a motor vehicle. The connectors allow various electronics to smoothly operate while exchanging the signals of such electronics through the connected connectors. In recent years, various devices have been developed for the efficient operation of motor vehicles and the control of the flow amount used in the motor vehicles, and the demand and importance for connectors for connecting signals transmitted from such devices have been increasing.

Connectors may be classified into a male connector and a female connector. The male connector and the female connector may constitute a connector assembly. A portion of the male connector is inserted into the female connector such that the terminals inserted into the respective connectors can be electrically interconnected. A locking structure is provided between the male connector and the female connector so that the male connector can be prevented from being separated from the female connector.

SUMMARY

One embodiment of the present disclosure provides a connector which has a structure capable of firmly seating a spring for applying a restoring force to a locking body in a connector body.

In the connector according to one embodiment of the present disclosure, the connector includes: a connector body formed with a terminal portion; a locking body slidably coupled to the connector body; and a spring including a first leg portion fixed in position inside the connector body and a second leg portion making contact with the locking body. The spring may be configured to apply a restoring force to the locking body in a direction in which the second leg portion is moved away from the first leg portion.

According to one embodiment, the spring may be configured as a torsion spring, and the torsion spring may include an elastic portion that is formed between the first leg portion and the second leg portion and is configured to be wound around an axis corresponding to a height direction of the connector body.

According to one embodiment, the connector body may include: an upper housing portion configured to accommodate the spring; and a lower housing portion formed at a lower side of the upper housing portion and including the terminal portion disposed therein.

According to one embodiment, the upper housing portion may include an intermediate wall formed with a guide slot to which the first leg portion is fixed.

According to one embodiment, the first leg portion may include a first extension portion configured to extend downward to be inserted into the guide slot, and the second leg portion may include a second extension portion configured to extend upward to make contact with the locking body.

According to one embodiment, the guide slot may be formed with an engagement projection configured to make contact with the first extension portion and to prevent the first leg portion from being separated.

According to one embodiment, the intermediate wall may be formed with a support protrusion configured to make contact with a lateral side of the elastic portion and to support the elastic portion.

According to one embodiment, the locking body may include: a bottom portion having a plate shape; an intermediate portion formed at an upper side of the bottom portion and protruding more inward than the bottom portion; and a locking protrusion formed at a lower side of the bottom portion. A tip end of the intermediate portion may be formed with a separation preventing protrusion configured to make contact with the second leg portion and to prevent separation of the second leg portion.

According to one embodiment, the connector body may be formed with a rail groove configured to guide movement of the intermediate portion.

In the connector assembly according to one embodiment, the connector assembly may include a first connector and a second connector. The first connector may include: a connector body formed with a terminal portion; a locking body slidably coupled to the connector body and formed with a locking protrusion; and a spring including a first leg portion fixed in position inside the connector body and a second leg portion making contact with the locking body. The second connector may include a terminal body formed with a contact protrusion which is configured to make contact with the locking protrusion and to move the locking body. The the spring may be configured to apply a restoring force to the locking body in a direction in which the second leg portion is moved away from the first leg portion.

According to one embodiment, the locking protrusion may include an inclined surface formed so as to face the contact protrusion, and an angle formed between the inclined surface and a longitudinal direction of the connector body may be 45° or more and 75° or less.

According to one embodiment, the contact protrusion may include: a curved surface having a convex shape toward the locking protrusion so as to make contact with the locking protrusion; and a contact inclined surface formed so as to incline from a tip end of the curved surface toward the opposite side of the curved surface.

According to one embodiment, both lateral sides of the connector body may be formed with guide rails extending along a longitudinal direction of the first connector, respectively, and both lateral sides of the terminal body may be formed with guide protrusions configured to be inserted into the guide rails respectively.

According to one embodiment, the terminal body may be formed with a fastening protrusion formed at a position spaced apart from the contact protrusion in a diagonal direction of the second connector, and the connector body may be formed with a protrusion groove configured such that the fastening protrusion is inserted into the protrusion groove.

According to one embodiment, the first connector may be configured to be coupled to the second connector when the fastening protrusion is inserted into the protrusion groove.

According to one embodiment, the second leg portion may be configured to approach the first leg portion when the contact protrusion makes contact with the locking protrusion and applies a pushing force to the locking protrusion.

According to the embodiment of the present disclosure, since the spring in the form of a torsion spring is provided, the spring can be firmly seated in the connector body. Further, since the inclination angle of the locking protrusion is set to 45° or more, the second connector can be separated from the first connector due to the repulsive force of the spring in the event that the coupling of the first connector to the second connector is incomplete.

DETAILED DESCRIPTION

Figure 1:
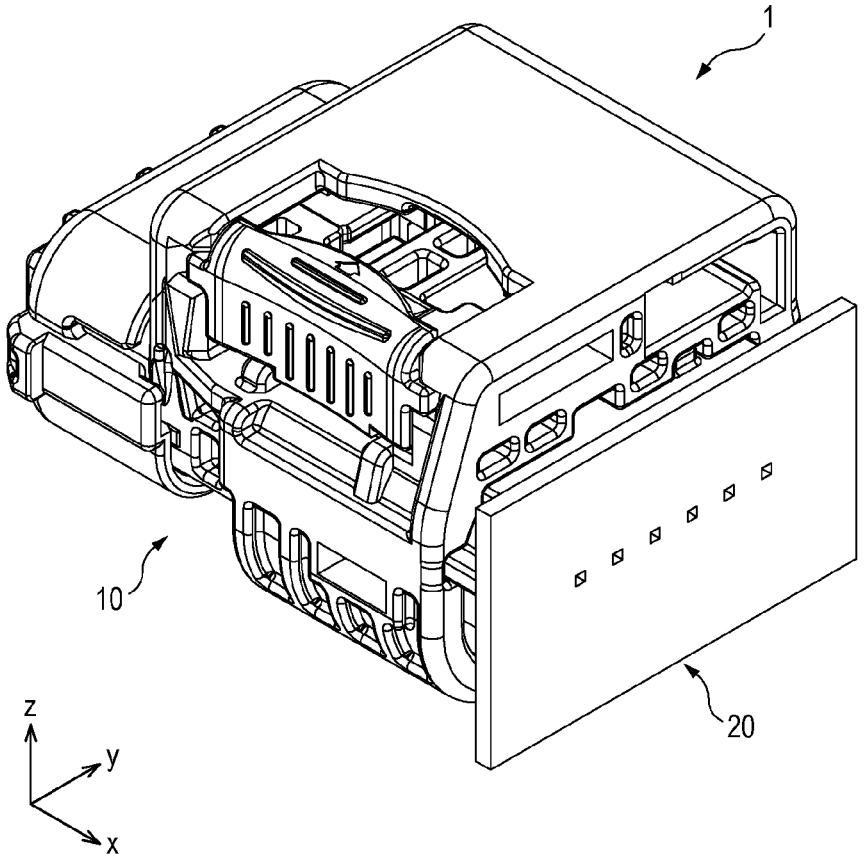
FIG. 1 is a perspective view showing a connector assembly according to one embodiment of the present disclosure.

Embodiments of the present disclosure are illustrated for the purpose of explaining the technical idea of the present disclosure. The scope of the rights according to the present disclosure is not limited to the embodiments presented below or the detailed descriptions of such embodiments.

All the technical terms and scientific terms used in the present disclosure include meanings that are commonly understood by those of ordinary skill in the technical field to which the present disclosure pertains unless otherwise defined. All terms used in the present disclosure are selected for the purpose of describing the present disclosure more clearly, and are not selected to limit the scope of the rights according to the present disclosure.

The expressions such as "comprising", "including", "having", and the like used in the present disclosure are to be understood as open-ended terms having the possibility of encompassing other embodiments, unless otherwise mentioned in the phrase or sentence containing such expressions.

The singular expressions described in the present disclosure may encompass plural expressions unless otherwise stated, which will be also applied to the singular expressions recited in the claims.

The expressions such as "first", "second", etc. used in the present disclosure are used to separate a plurality of elements from each other, and are not intended to limit an order or importance of the elements.

In the present disclosure, the description that one element is "connected" or "coupled" to another element should be appreciated to indicate that one element may be directly connected or coupled to another element, and should be further understood that one element may be connected or coupled to another element via a new element.

The dimensional and numerical values described in the present disclosure are not limited only to the dimensional and numerical values described herein. Unless specified otherwise, the dimensional and numerical values may be understood to mean the described values and the equivalent ranges including the values. For example, the dimension of "45°" described in the present disclosure may be understood to include "about 45°".

The directional terms "upward", "upper", and the like used in the present disclosure are based on a direction in which an upper housing portion is positioned with respect to a lower housing portion in the accompanying drawings, while the directional terms "downward", "lower", and the like refer to a direction opposite to the upward or upper direction. The connector shown in the accompanying drawings may be oriented differently, and the directional terms may be construed accordingly.

The coordinate system shown in the drawings of the present disclosure shows an X-axis, a Y-axis, and a Z-axis. The X-axis direction refers to a direction parallel to a longitudinal direction of a connector, the Y-axis direction refers to a direction parallel to a width direction of the connector, and the Z-axis direction refers to a direction parallel to a height direction of the connector. Further, the X-axis positive direction refers to a direction outward in the longitudinal direction, and the X-axis negative direction refers to a direction inward in the longitudinal direction. Further, the Y-axis positive direction refers a direction inward in the width direction, and the Y-axis negative direction refers to a direction outward in the width direction. Further, the Z-axis positive direction refers to a direction upward in the height direction, and the Z-axis negative direction refers to a direction downward in the height direction.

Hereinafter, descriptions of the embodiments of the present disclosure are made with reference to the accompanying drawings. Like reference numerals in the accompanying drawings denote like or corresponding elements. Further, in the following descriptions of the embodiments, duplicate descriptions for the same or corresponding elements may be omitted. However, even if the descriptions of the elements are omitted, such elements are not intended to be excluded in any embodiment.

Figure 2:
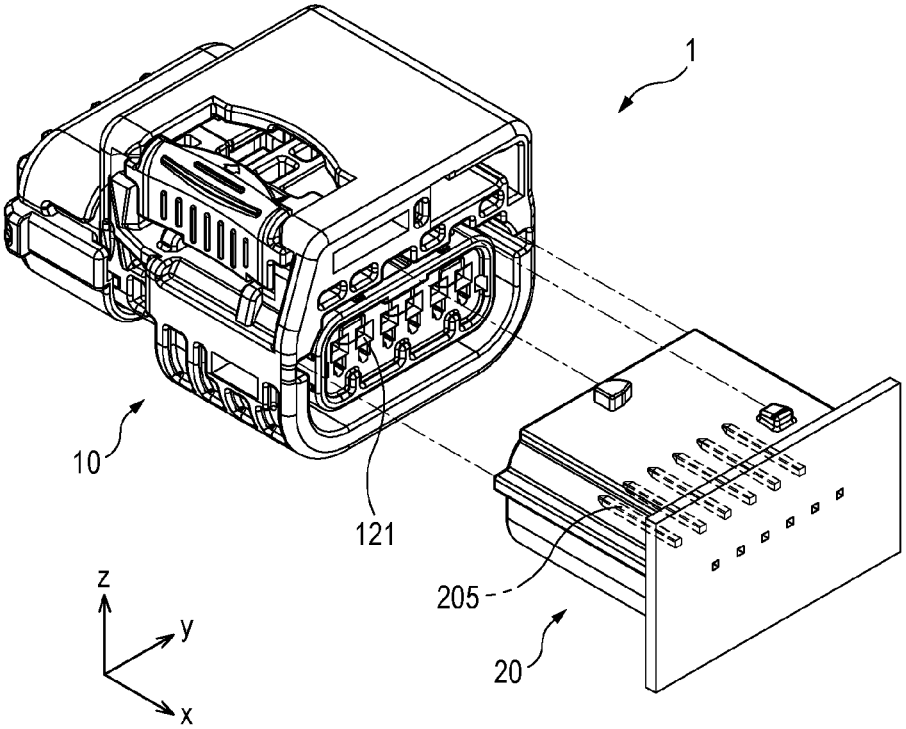
FIG. 2 is an exploded perspective view of the connector assembly according to one embodiment of the present disclosure.

FIG. 1 is a perspective view showing a connector assembly according to one embodiment of the present disclosure, and FIG. 2 is an exploded perspective view of the connector assembly according to one embodiment of the present disclosure.

The connector assembly 1 may be configured to interconnect terminals constituting an electrical system of a motor vehicle. For example, the connector assembly 1 may be configured to electrically connect an electronic control unit (ECU) of a motor vehicle and a circuit of a shock absorbing device (e.g., an airbag unit). The respective parts constituting the connector assembly 1 may be coupled to each other by a locking structure.

The connector assembly 1 may include a first connector 10 and a second connector 20. The first connector 10 may be referred to as a female connector. The first connector 10 may be formed with terminal portions 121, and female terminals made of a conductive material may be disposed inside the respective terminal portions 121. The second connector 20 may be referred to as a male connector. Male terminals 205 made of a conductive material may be disposed in the second connector 20. For example, the second connector 20 may be fixed to a device such as an airbag unit (not shown). In contrast, the first connector 10 may be connected to an ECU (not shown) of a motor vehicle, and may be moved toward the second connector 20 because the first connector is not fixed in position.

A portion of the second connector 20 may be inserted into the first connector 10. In such a case, the male terminals 205 of the second connector 20 may be connected to the female terminals of the first connector 10. Further, a locking structure is provided between the first connector 10 and the second connector 20, and thus the first connector 10 is not easily separated from the second connector 20 after the first connector 10 is completely coupled to the second connector 20. Further, the first and second connectors 10 and 20 may be manufactured from, for example, glass-fiber-reinforced plastic.

Figure 3:
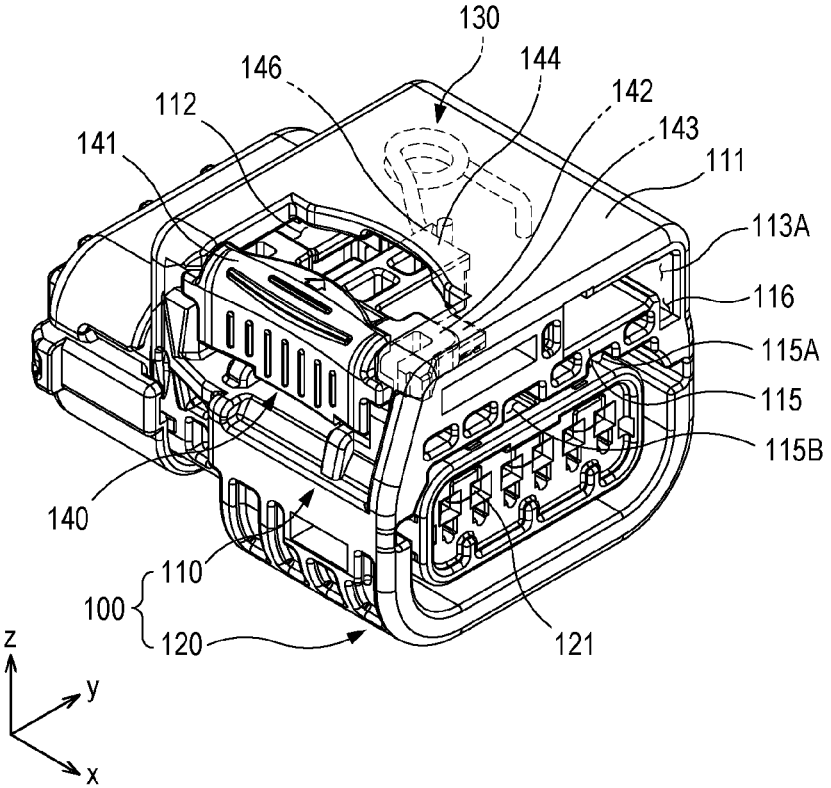
FIG. 3 is a perspective view showing a first connector of the connector assembly shown in FIG. 2.
Figure 4:
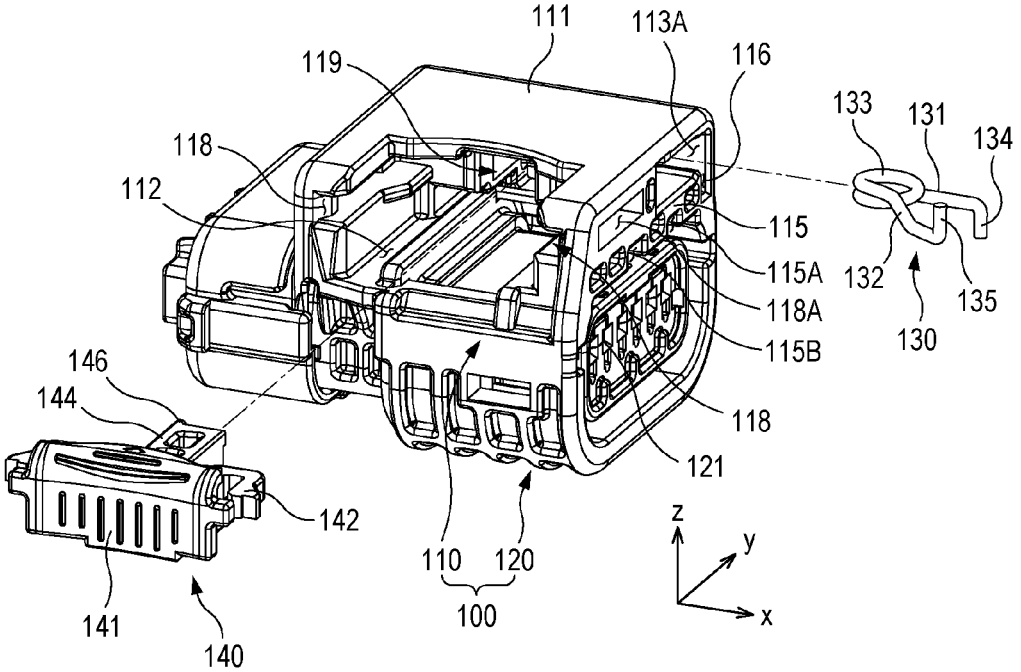
FIG. 4 is an exploded perspective view of the first connector shown in FIG. 3.
Figure 5:
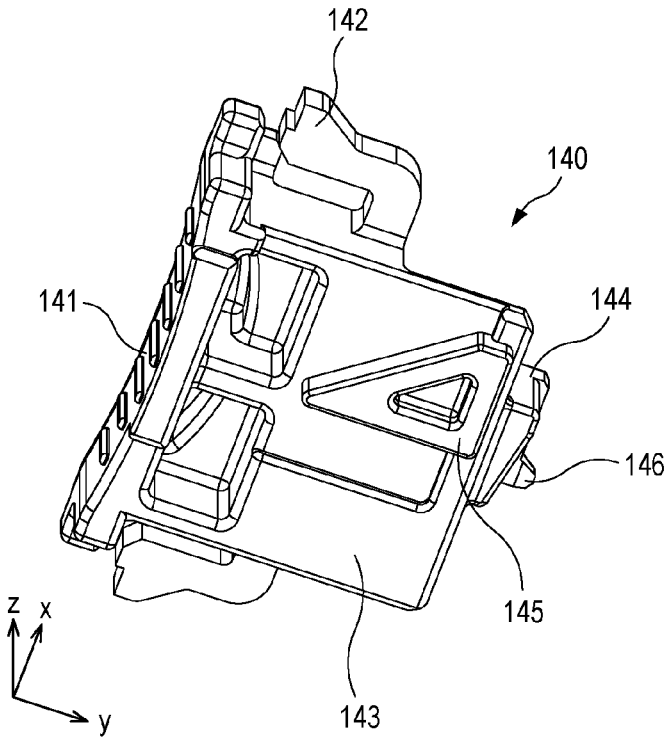
FIG. 5 is a lower perspective view of a locking body shown in FIG. 4.

FIG. 3 is a perspective view showing the first connector of the connector assembly shown in FIG. 2. FIG. 4 is an exploded perspective view of the first connector shown in FIG. 3. FIG. 5 is a lower perspective view of a locking body shown in FIG. 4. The first connector 10 may include a connector body 100, a locking body 140, and a spring 130.

The connector body 100 may include an upper housing portion 110 and a lower housing portion 120, which are disposed at an upper side and a lower side, respectively, along the height direction (Z-axial direction). The upper housing portion 110 may accommodate the spring 130. The lower housing portion 120 may be formed with the terminal portions 121. The terminal portions 121 may be formed to be directed in the longitudinal direction (X direction).

The upper housing portion 110 may include an upper wall 111 that covers the spring 130 and a portion of the locking body 140. Further, the upper housing portion 110 may include an intermediate wall 115 that forms a boundary between the upper housing portion and the lower housing portion 120. The intermediate wall 115 may be formed with a guide slot 116 which extends along the longitudinal direction (X direction).

The spring 130 may include a first leg portion 131 fixed in position inside the connector body 100 and a second leg portion 132 in contact with the locking body 140. Further, the spring 130 may apply a restoring force to the locking body 140 in a direction (Y direction) in which the second leg portion 132 is moved away from the first leg portion 131. That is, in the state where the second leg portion 132 is in contact with the locking body 140, the spring 130 continuously applies a force to the locking body 140 in the direction directed toward the outside in the width direction (Y direction). The spring 130 may be inserted into a rail opening 113A of the upper housing portion 110, and details related thereto will be described below.

Referring to FIG. 4, the spring 130 may be configured as, for example, a torsion spring. The torsion spring may include an elastic portion 133 which is formed between the first leg portion 131 and the second leg portion 132 and is configured to be wound around an axis corresponding to the height direction (Z direction). Further, the elastic portion 133 may have a coil shape. The first leg portion 131 may extend from a lower end of the coil shape, and the second leg portion 132 may extend from an upper end of the coil shape.

The first leg portion 131 may include a first extension portion 134 which is configured to extend downward in the height direction (Z direction) to be inserted into the guide slot 116. The second leg portion 132 may include a second extension portion 135 which is configured to extend upward in the height direction (Z direction) to make contact with the locking body 140. The second leg portion 132 may have a shape that is inclined so as to descend downward in the height direction (Z direction). Accordingly, it is possible to minimize the interference between the second extension portion 135 and the upper wall 111.

The locking body 140 may be disposed in a locking body accommodating portion 112 formed in the upper housing portion 110. Further, the locking body 140 may be slidably coupled to the upper housing portion 110. The locking body 140 may slide in the width direction (Y direction) with respect to the connector body 100.

Referring to FIG. 5, the locking body 140 may include a handle portion 141 for an operator to grip with a hand, a bottom portion 143 having a plate shape, an intermediate portion 144 formed at an upper side of the bottom portion 143 and protruding more inward than the bottom portion 143, and a locking protrusion 145 formed at a lower side of the bottom portion 143. Further, coupling wings 142 for coupling with the upper housing portion 110 may be formed on both sides of the handle portion 141, respectively.

The upper housing portion 110 may be formed with a rail groove 119 configured to guide the movement of the intermediate portion 144. Further, the upper housing portion 110 may be formed with wing slots 118 configured to guide the coupling wings 142. The rail groove 119 and the wing slots 118 may extend along the width direction (Y direction). Further, tip ends of the coupling wings 142 may be inserted into wing openings 118A after passing through the wing slots 118. Accordingly, even if the restoring force of the spring 130 acts on the locking body 140, the locking body 140 is not separated from the upper housing portion 110.

Figure 6:
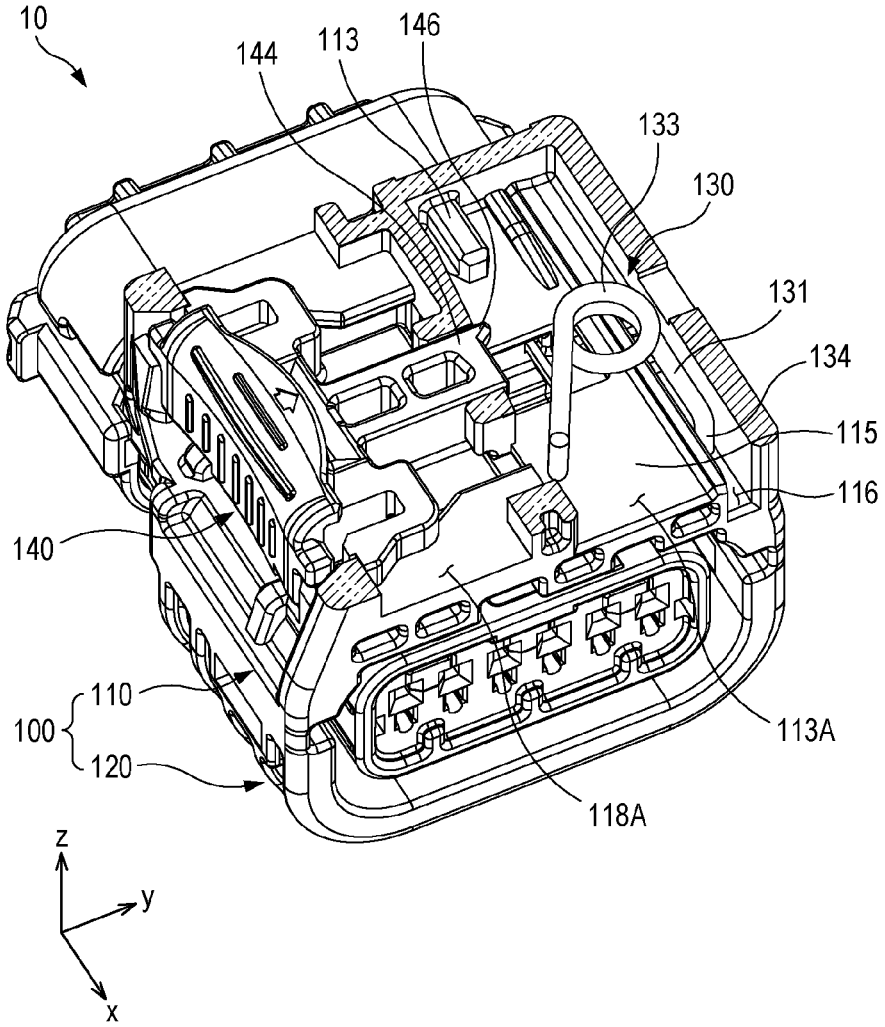
FIG. 6 is a perspective view showing a process where a spring is coupled to a connector body.
Figure 7:
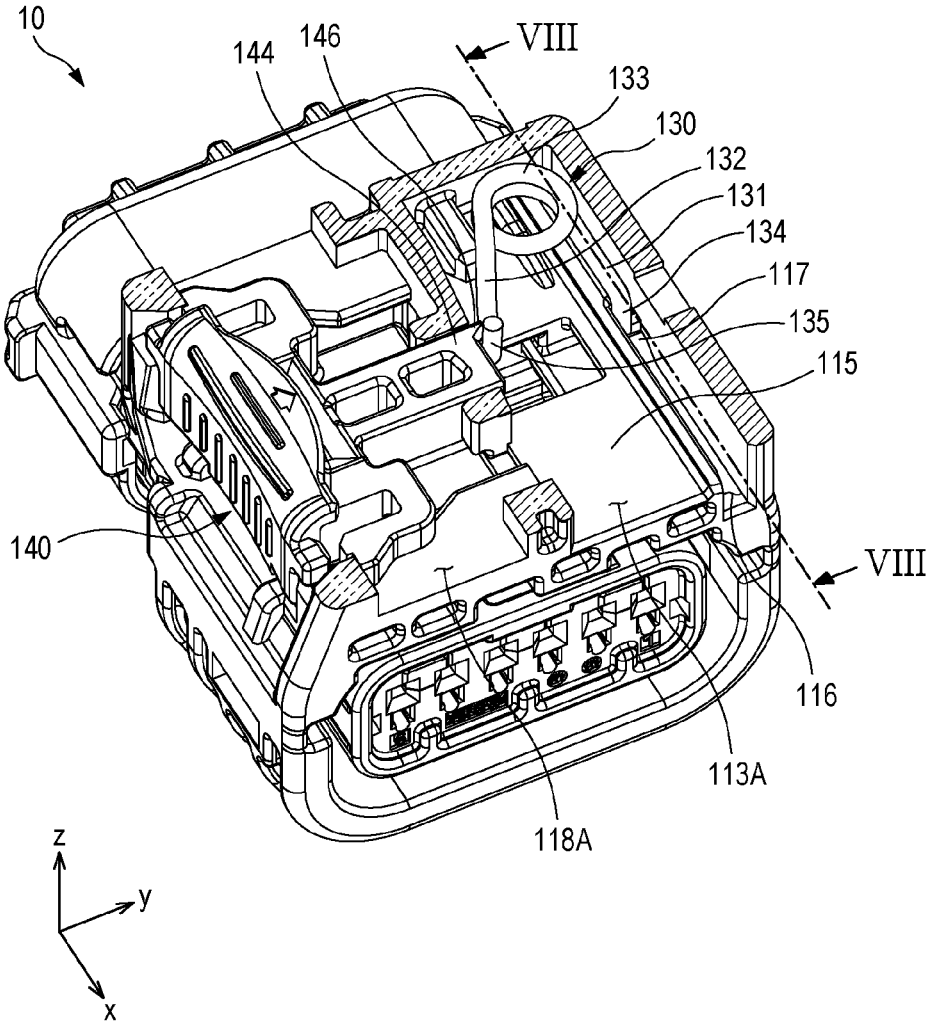
FIG. 7 is a perspective view showing the process where the spring is coupled to the connector body.
Figure 8:
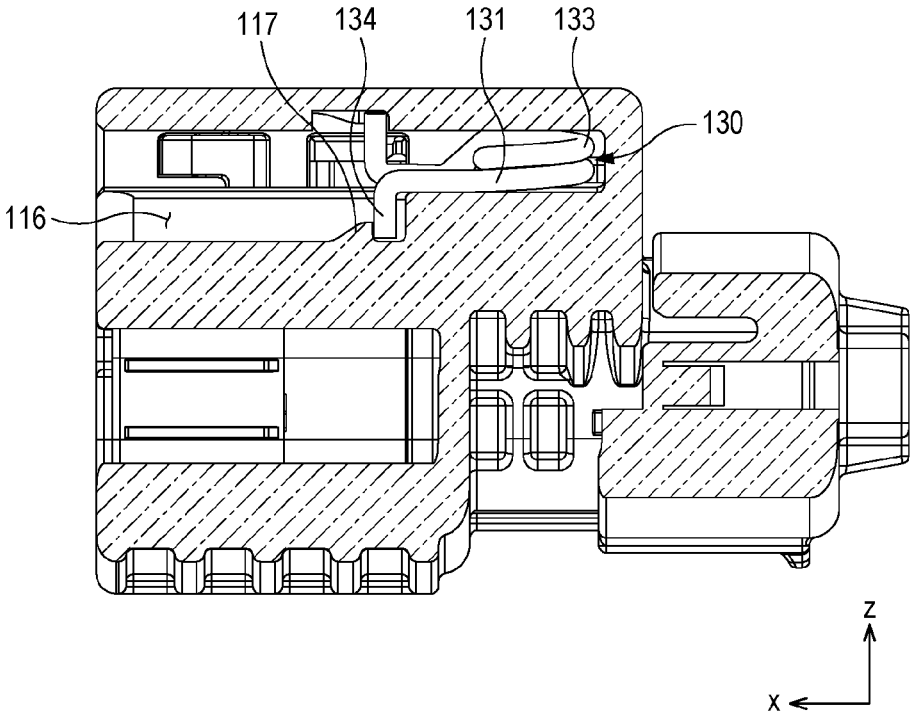
FIG. 8 is a cross-sectional view taken along the line VIII-VIII of FIG. 7.

FIGS. 6 and 7 are perspective views for explaining a process where the spring 130 is coupled to the connector body 100. FIG. 8 is a cross-sectional view taken along the line VIII-VIII of FIG. 7. For ease of description, FIGS. 6 and 7 show the state where the upper wall 111 is removed.

FIG. 6 shows a state where the spring 130 is inserted into the rail opening 113A of the upper housing portion 110 and thereafter is moved in the longitudinal direction (X direction). At this time, the first extension portion 134 may be in the state of being positioned in the guide slot 116. If the operator changes the position of the first connector 10 such that the rail opening 113A is directed upward in the height direction (Z direction), then the spring 130 falls downward in the height direction (Z direction) due to gravity.

FIGS. 7 and 8 show a state where the spring 130 is completely coupled to the upper housing portion 110. In this state, the second extension portion 135 may be brought into contact with the tip end of the intermediate portion 144 of the locking body 140. Further, the tip end of the intermediate portion 144 may be formed with a separation preventing protrusion 146 which is configured to make contact with the second extension portion 135 and to prevent separation of the second leg portion 132. Accordingly, in the state where the second leg portion 132 pushes the locking body 140 to the maximum, the separation preventing protrusion 146 may maintain the contact between the second extension portion 135 and the intermediate portion 144.

The guide slot 116 may be formed with an engagement projection 117 which is configured to make contact with the first extension portion 134 and to prevent the first leg portion 131 from being separated. The operator may push the spring 130 inward by means of a tool such as a pin (not shown) such that the first extension portion 134 passes through the engagement projection 117. Since the engagement projection 117 is located outside the first extension portion 134, the spring 130 may not be separated outward from the upper housing portion 110.

The intermediate wall 115 may be formed with a support protrusion 113 which is configured to make contact with a lateral side of the elastic portion 133 and to support the elastic portion 133. Therefore, the spring 130 can be supported by the support protrusion 113 so as not to be shaken in the width direction (Y direction).

FIGS. 9 to 13 are top views showing processes where the first connector is coupled to the second connector. The coupling between the first connector 10 and the second connector 20 may be performed in sequence of FIGS. 9 to 13. For ease of description, FIGS. 9 to 13 show the state where the upper wall 111 is removed.

The second connector 20 may include a terminal body 210 formed with a contact protrusion 220 which is configured to make contact with the locking protrusion 145 and to move the locking body 140. Further, the terminal body 210 may be formed with a fastening protrusion 230 which is formed at a position spaced apart from the contact protrusion in a diagonal direction (X and Y directions) of the second connector.

The intermediate wall 115 of the upper housing portion 110 may be formed with a first protrusion groove 115A into which the fastening protrusion 230 is inserted. Further, the intermediate wall 115 of the upper housing portion 110 may be formed with a second protrusion groove 115B into which the contact protrusion 220 is inserted.

The locking protrusion 145 may include an inclined surface 150 which is formed so as to face the contact protrusion. Further, an angle θ formed between the inclined surface 150 and the longitudinal direction (X-axial direction) may be 45° or more. As the angle θ increases, the required connector insertion force increases, and detailed descriptions related thereto will be described below.

The contact protrusion 220 may include a first vertical surface 221, a curved surface 222 having a convex shape toward the locking protrusion 145 so as to make contact with the locking protrusion 145, a contact inclined surface 223 formed so as to incline from a tip end of the curved surface 222 to the opposite side of the curved surface 222, and a second vertical surface 224. The curved surface 222 may have a shape of a circular arc surface generally corresponding to a portion of a cylindrical surface. The first vertical surface 221 and the second vertical surface 224 may be formed in parallel with the width direction (Y direction).

Figure 9:
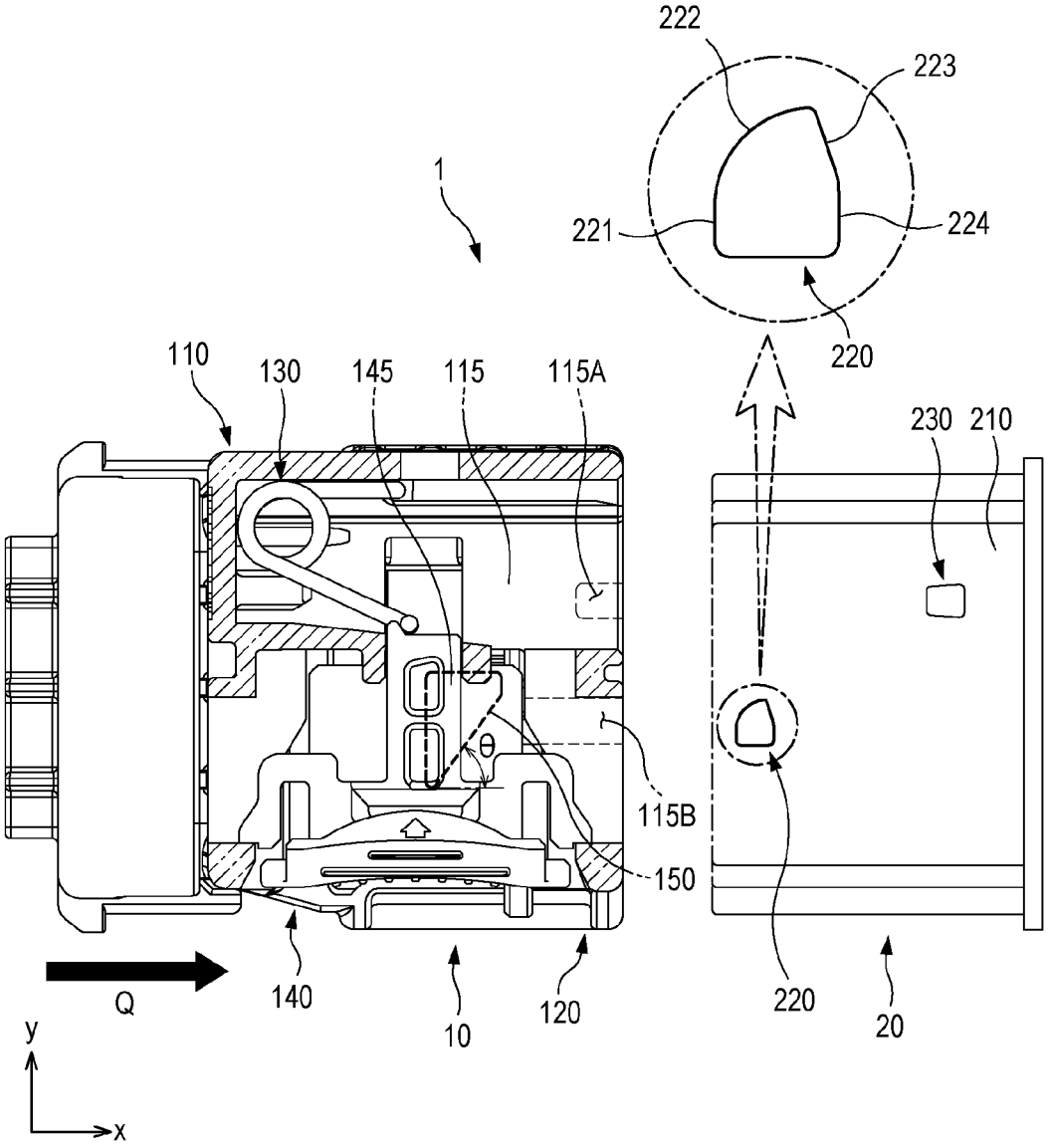
FIG. 9 is a top view showing a process where a first connector is coupled to a second connector.

FIG. 9 shows a first phase of the coupling process. In this phase, the first connector 10 and the second connector 20 may be aligned along the longitudinal direction (X-axis). Further, the relative position of the first connector 10 with respect to the second connector 20 may be adjusted such that the locking protrusion 145 and the contact protrusion 220 are positioned at the same height. When the first connector 10 is moved toward the second connector 20 in a direction of an arrow Q, the terminal body 210 may be first inserted into the lower housing portion 120, and then the contact protrusion 220 may be inserted into the second protrusion groove 115B.

Figure 10:
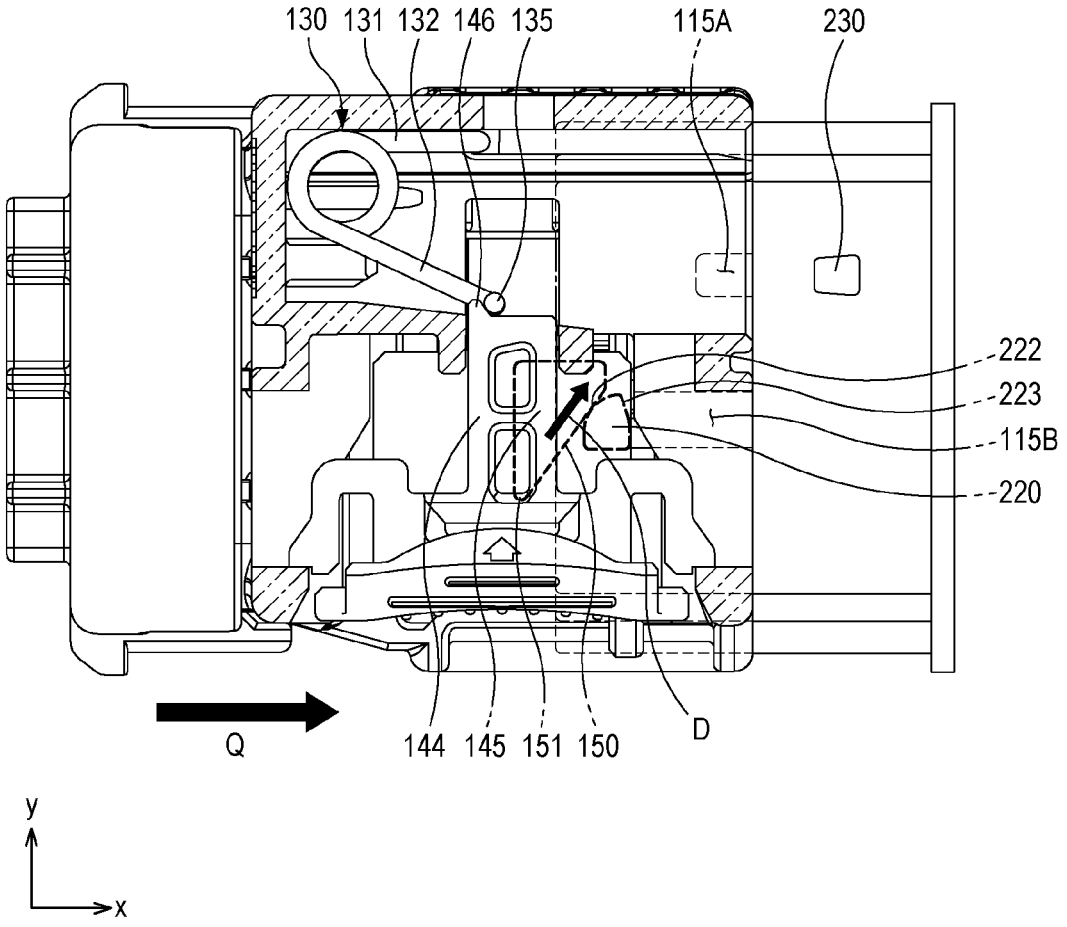
FIG. 10 is a top view showing a process where the first connector is coupled to the second connector.

FIG. 10 shows a second phase of the coupling process. In this phase, subsequent to the first phase, the first connector 10 continues to be moved in the direction toward the second connector 20, and then the locking protrusion 145 of the locking body 140 may be brought into contact with the contact protrusion 220 of the terminal body 210. Specifically, the inclined surface 150 of the locking protrusion 145 may be brought into contact with the curved surface 222 of the contact protrusion 220. Even at this time, the fastening protrusion 230 is in the state where the fastening protrusion is not inserted into the first protrusion groove 115A. Further, deformation does not occur in the spring 130.

Further, the inclined surface 150 and the curved surface 222 may be substantially brought into line contact with each other. Therefore, excessive friction between the locking protrusion 145 and the contact protrusion 220 can be prevented, and damage of the locking protrusion and the contact protrusion can be prevented.

Figure 11:
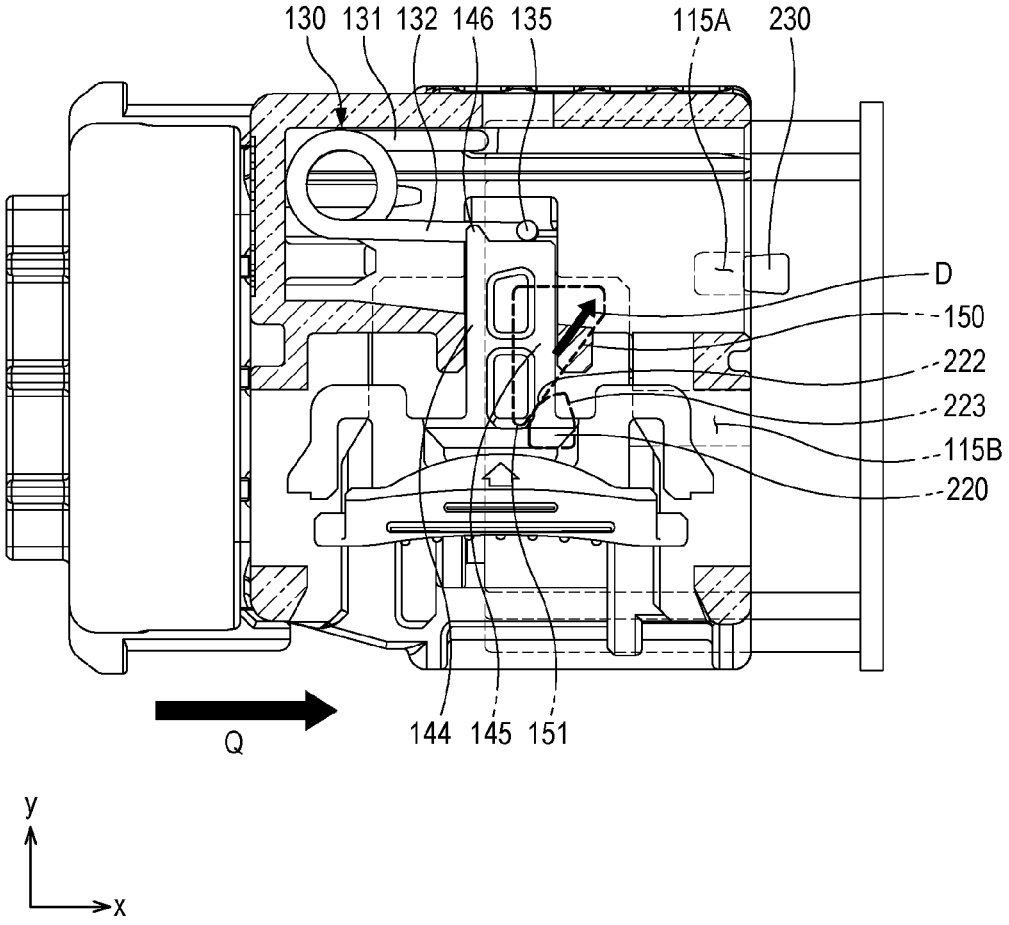
FIG. 11 is a top view showing a process where the first connector is coupled to the second connector.

FIG. 11 shows a third phase of the coupling process. In this phase, subsequent to the second phase, as the first connector 10 is moved in the direction toward the second connector 20, the locking protrusion 145 applies a pushing force to the contact protrusion 220. However, since the position of the second connector 20 is fixed, the contact protrusion 220 is not moved, but the locking protrusion 145 is moved in the direction of an arrow D in response to the reaction force acting on the locking protrusion 145 by the contact protrusion 220. The direction of the arrow D may be a diagonal direction (X and Y directions). Since the first connector 10 is moved in the direction of the arrow Q, the locking protrusion 145 may be moved substantially in the diagonal direction.

The spring 130 may be compressed due to the contact with the locking body 140. The second leg portion 132 may be configured to approach the first leg portion 131 when the contact protrusion 220 makes contact with the locking protrusion 145 and applies the pushing force to the locking protrusion. At this time, the second extension portion 135 of the second leg portion 132 may make contact with the tip end of the intermediate portion 144 of the locking protrusion 145, and the second extension portion 135 may also make contact with the separation preventing protrusion 146.

Figure 12:
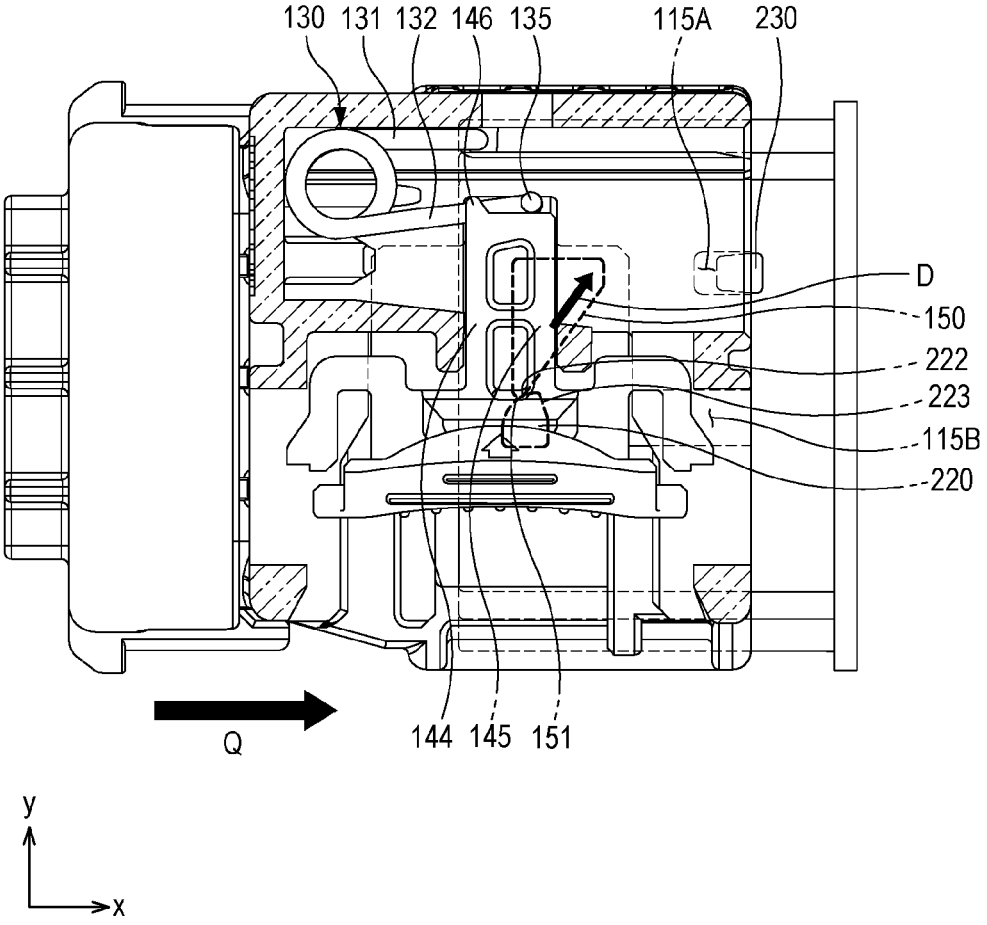
FIG. 12 is a top view showing a process where the first connector is coupled to the second connector

FIG. 12 shows a fourth phase of the coupling process. In this phase, subsequent to the third phase, the locking protrusion 145 is shown immediately before going over a peak point between the curved surface 222 and the contact inclined surface 223. At this time, the spring 130 may be substantially in the state of maximal compression. Further, if the locking protrusion 145 goes over the peak point, a lower tip end 151 of the locking protrusion 145 may make contact with the contact inclined surface 223 of the contact protrusion 220. At this time, due to the restoring force of the spring 130, the locking protrusion 145 may be moved to rapidly descend along the contact inclined surface 223.

Figure 13:
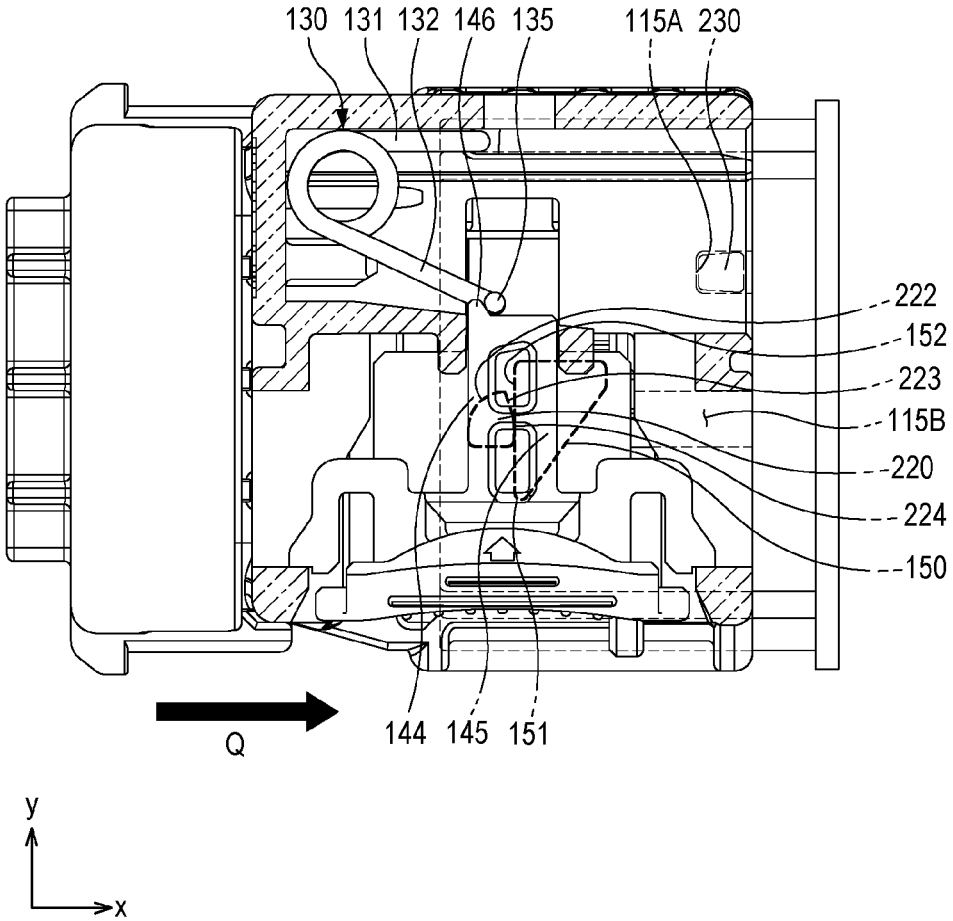
FIG. 13 is a top view showing a process where the first connector is coupled to the second connector.

FIG. 13 shows a fifth phase of the coupling process. In this phase, the coupling of the first connector 10 to the second connector 20 is completed. A rear end surface 152 of the locking protrusion 145 may be brought into contact with the second vertical surface 224 of the contact protrusion 220. Further, unless a special case occurs, the first connector 10 is not separated from the second connector 20. The aforementioned special case refers to, for example, a case where the locking protrusion 145 or the contact protrusion 220 is damaged. Further, the fastening protrusion 230 is inserted into the first protrusion groove 115A. By checking the insertion of the fastening protrusion into the first protrusion groove, the operator may determine that the coupling between the first connector 10 and the second connector 20 is completed.

Figure 14:
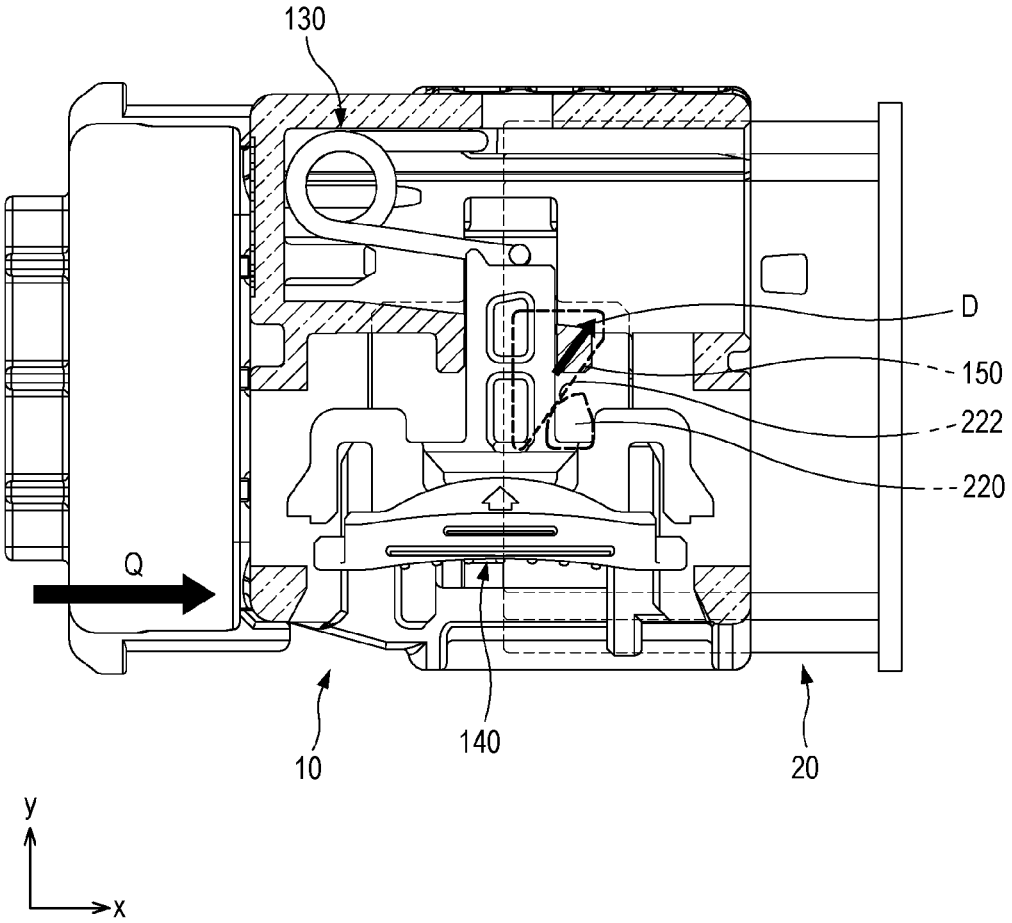
FIG. 14 is a top view showing a process where a repulsive force of the spring acts when the first connector is incompletely coupled to the second connector.
Figure 15:
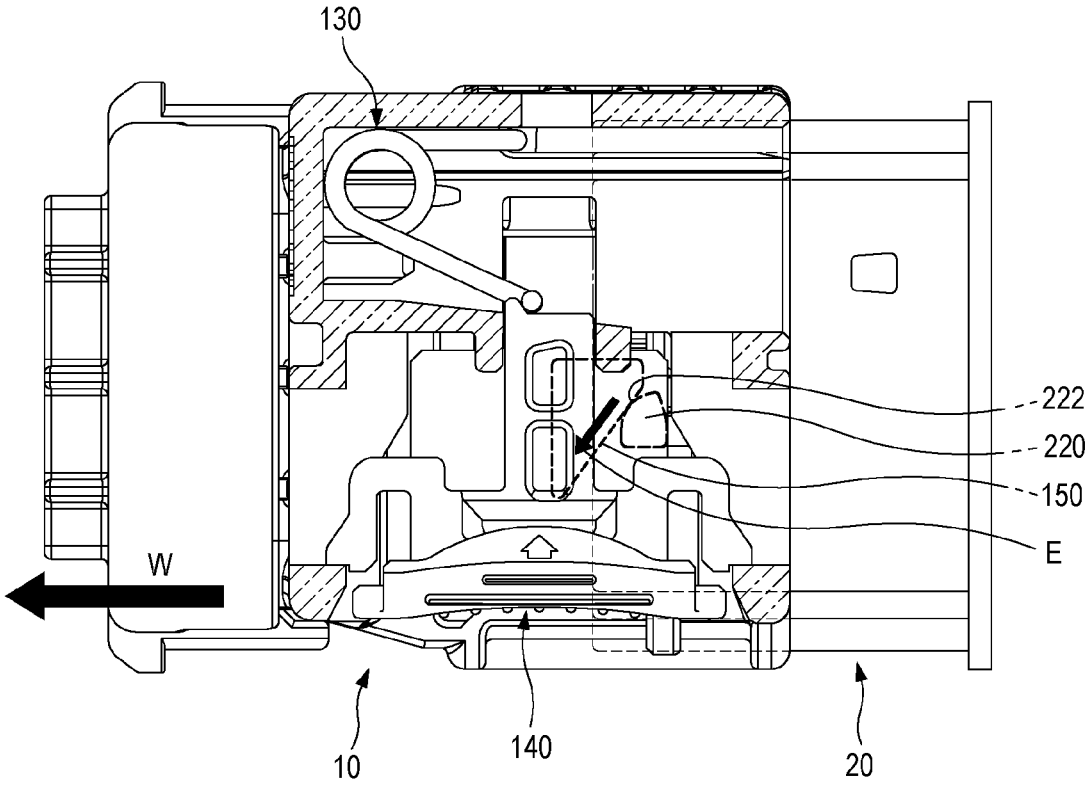
FIG. 15 is a top view showing a process where the repulsive force of the spring acts when the first connector is incompletely coupled to the second connector.
Figure 16:
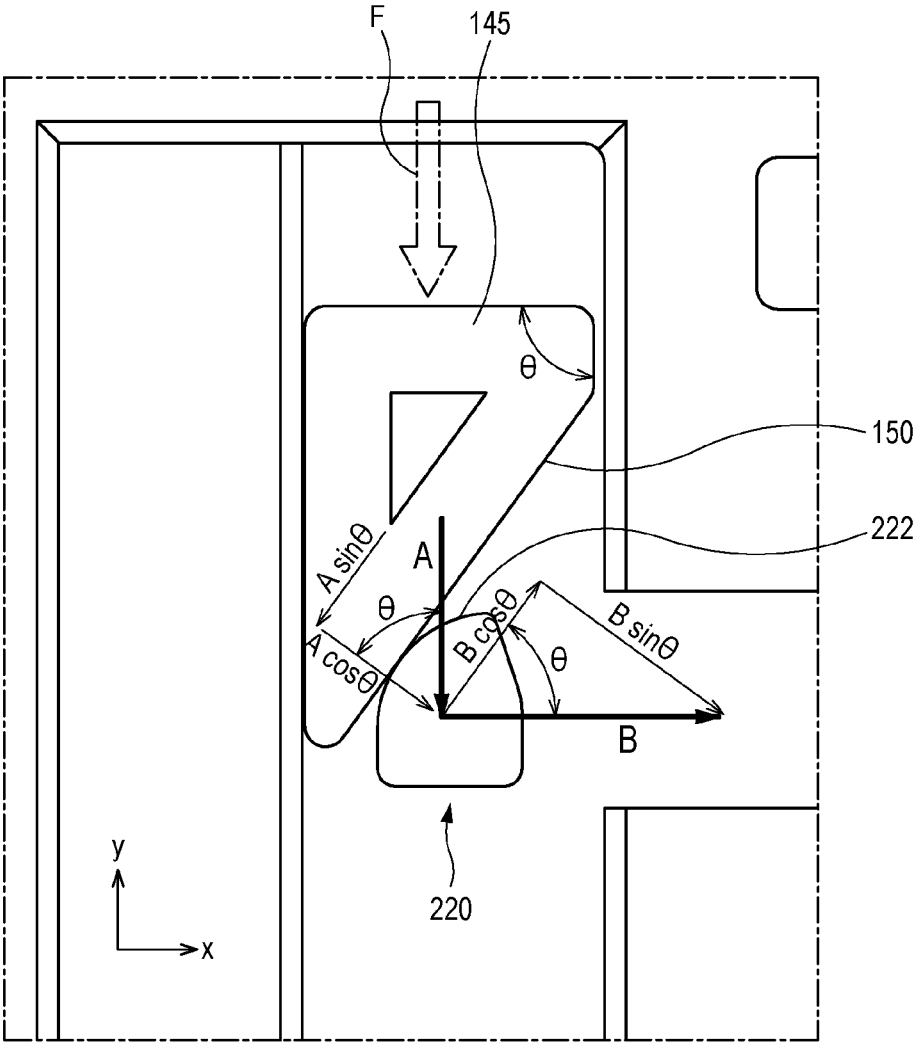
FIG. 16 is a top view showing a process where the repulsive force of the spring acts when the first connector is incompletely coupled to the second connector.

FIGS. 14 to 16 are top views showing a process where a repulsive force of the spring acts in the event that the first connector is incompletely coupled to the second connector. For ease of description, FIGS. 14 to 16 show the state where the upper wall 111 is removed.

FIG. 14 shows a situation where the operator applies an external force to the first connector 10 and the first connector 10 is being moved toward the second connector 20 in the direction of an arrow Q. In this situation, the locking body 140 may be moved in the diagonal direction (in the direction of the arrow D) along the contact protrusion 220.

FIG. 15 shows a situation where the operator stops applying an external force when the locking protrusion 145 fails to completely go over the contact protrusion 220. In this case, the first connector 10 may be pushed from the second connector 20 in a direction W due to the restoring force of the spring 130. That is, when the first connector 10 is inserted into the second connector 20, if the insertion force is insufficient or the movement is stopped on the way, the first connector 10 may be moved in the direction opposite to the insertion direction (in the direction of the arrow W). Such a case cannot be the proper connector insertion process.

As shown in FIG. 15, the first and second connectors 10 and 20 may not be completely coupled due to carelessness of the operator during the coupling operation between the first and second connectors. In such a case, the terminals of the first connector 10 and the terminals of the second connector 20 may be electrically connected to each other. However, since the connectors are not fixed, the connectors may be separated during the operation of a motor vehicle, which may result in losing a function of a component.

In order to prevent the aforementioned problem, a specific system (e.g., a system in which the second connector 20 is used as a connector for an airbag unit (not shown)) may require the connectors to have a function that prevents electrical connection between the connectors in the event the connectors are not completely coupled and enables the operator to recognize the incomplete coupling state. The connectors having such a function may be referred to as a "GO-NO-GO connector". Since the function of "GO-NO-GO" is applied to the connector assembly according to one embodiment of the present disclosure, if the coupling process of the first and second connectors 10 and 20 is completed in the state where the locking protrusion 145 fails to completely go over the contact protrusion 220, the first connector 10 may be pushed in a direction opposite to the coupling direction.

FIG. 16 illustrates a process of setting the force of the spring 130 and the angle θ of the inclined surface 150. The force F shown in FIG. 16 refers to the force which the spring 130 applies to the locking body 140. The force F may be substantially the same as the force which the locking protrusion 145 applies to the contact protrusion 220. The force A of the spring 130 and the angle θ of the inclined surface 150 may be set through the following calculation processes.

(1) Correlation of A, B, and θ

A: Force of the spring 130

B: Reaction force of the contact protrusion 220 in the event of incomplete coupling (=the force which the locking protrusion 145 applies to the contact protrusion 220 in the longitudinal direction (X direction) during insertion of the connector)

θ: Angle of the inclined surface 150

$B\cos\theta - A\sin\theta = 0$ $B = A\sin\theta/\cos\theta = A\tan\theta$ (friction force omitted)

(2) Setting range of B (upper limit)

Connector insertion force specification: Connector insertion force of 7.6 kgf or less Insertion force of other parts inside the connector (terminal and seal)+B<7.6 kgf Considering allowance rate of about 10%: Insertion force of other parts inside the connector (terminal and seal)+B<7 kgf Terminal insertion force (0.35 kgf*6 pcs)+seal insertion force (1 kgf)=3.1 kgf (set by experience such as past data)

Excluding insertion force of other parts inside the connector: B<3.9 kgf (3) Setting range of B (lower limit)

The reaction force in the event of incomplete coupling should be greater than the insertion force of other parts inside the connector Terminal insertion force (0.35 kgf*6 pcs)+seal insertion force (1 kgf)<B<3.9 kgf 3.1 kgf<B<3.9 kgf Considering the frictional force of each part, the value of B needs to be set as the upper limit of the range.

(4) Setting of A

The spring force affects a part having an inclined surface structure at the time of coupling the connectors, and the rigidity of the part should be considered (the spring contact portion and the fixed portion of a part having an inclined surface structure)

The spring force is the same as the pushing force applied to the locking body by the operator at the time of decoupling the connectors, and the convenience needs to be considered: The target is set to be less than 3 kgf The spring force designed considering the interior space of the connector: 2.7 kgf (5) Setting of angle θ of inclined surface 150

$B = A\tan\theta \leftarrow B$: 3.8 kgf (target value)/A: 2.7 kgf (designed value)

$\tan\theta = 1.41$, $\theta = 54.65°$

Through the above-described processes, the force A of the spring 130 may be, for example, 2.7 kgf. Further, the number of turns of the elastic portion 133 may be determined according to the force of the spring 130. For example, like the spring 130 shown in FIG. 4, the number of turns of the elastic portion 133 may be two. Further, through the above-described processes, the angle θ of the inclined surface 150 may be, for example, 54.65°. That is, the angle θ of the inclined surface 150 may be 45° or more. Further, the angle θ of the inclined surface 150 may be 75° or less such that the connector insertion force is not excessively increased.

Figure 17:
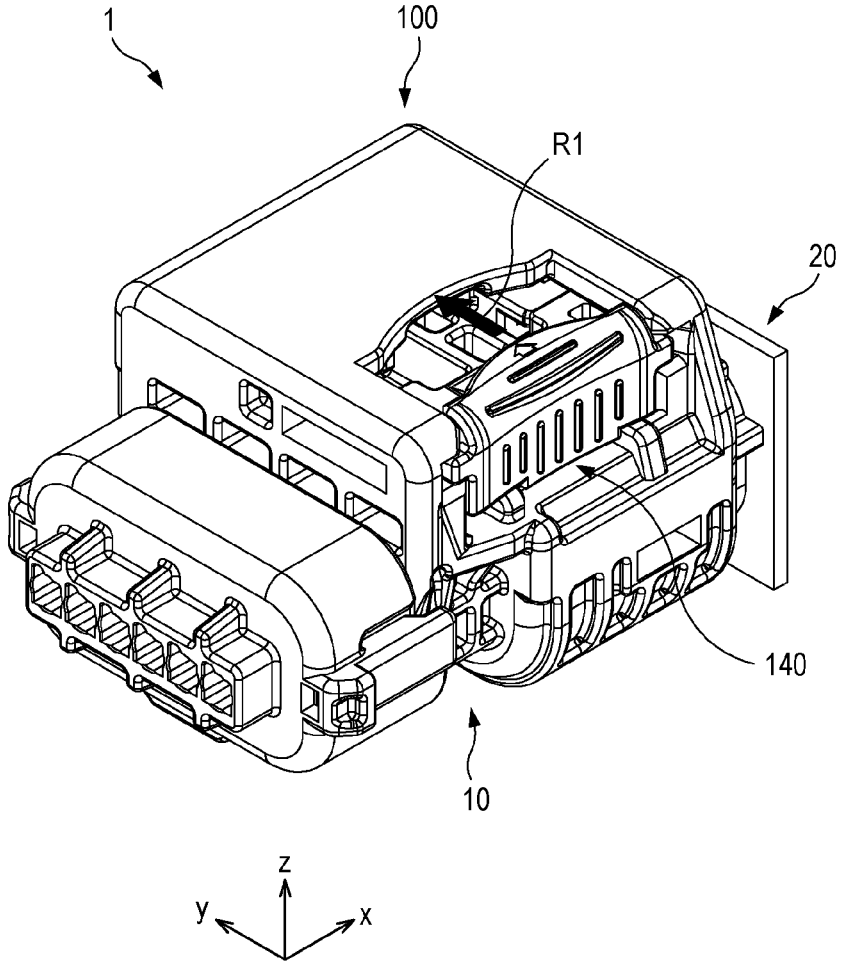
FIG. 17 is a perspective view showing a process where the first connector is separated from the second connector.
Figure 18:
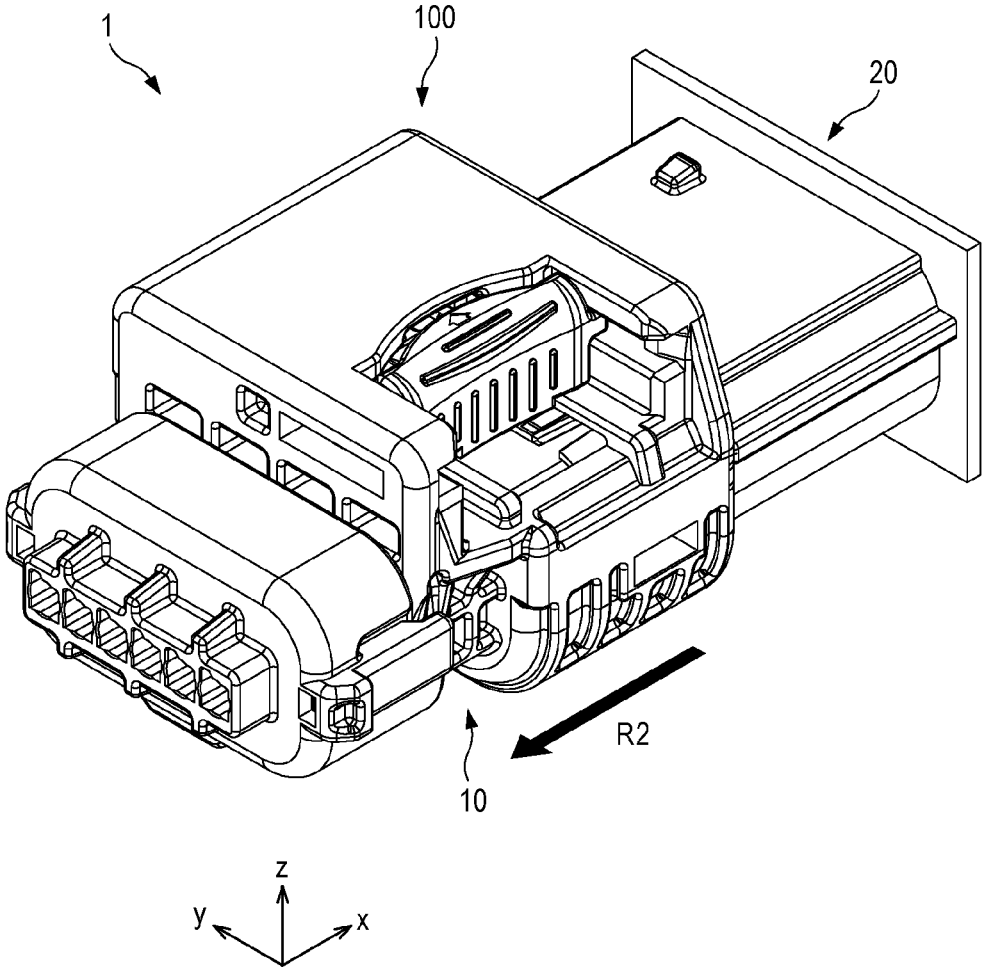
FIG. 18 is a perspective view showing a process where the first connector is separated from the second connector.

FIGS. 17 and 18 are perspective views for explaining a process where the first connector 10 is separated from the second connector 20.

For maintenance or repair of the connector assembly 1, the operator may separate the first connector 10 from the second connector 20. Referring to FIG. 17, first, the operator may push the locking body 140 into the connector body 100 (in a direction R1) by a hand. If the movement of the locking body 140 is insufficient, the locking protrusion 145 is caught by the contact protrusion 220 and therefore the first connector 10 cannot be separated from the second connector 20. Therefore, it is necessary for the operator to push the locking body 140 to the inner end of the connector body 100. Referring to FIG. 18, if the first connector 10 is moved in a separation direction R2 in the state where the locking body 140 is pushed to the inner end of the connector body 100, the first connector 10 can be separated from the second connector 20.

The technical idea of the present disclosure has been described heretofore with reference to some embodiments and examples shown in the accompanying drawings. However, it is to be understood that various substitutions, modifications and alterations may be made without departing from the technical idea and scope of the present disclosure that can be understood by those of ordinary skill in the technical field to which the present disclosure pertains. Further, it is to be understood that such substitutions, modifications and alterations fall within the appended claims.

What is claimed is:

1. A connector comprising:

a connector body formed with a terminal portion;

a locking body slidably coupled to the connector body; and a spring including a first leg portion fixed in position inside the connector body and a second leg portion making contact with the locking body, wherein the spring is configured as a torsion spring, and wherein the torsion spring includes an elastic portion that is formed between the first leg portion and the second leg portion and is configured to be wound around an axis corresponding to a height direction of the connector body, wherein the connector body includes an upper housing portion configured to accommodate the spring and a lower housing portion formed at a lower side of the upper housing portion and including the terminal portion disposed therein, wherein the upper housing portion includes an intermediate wall formed with a guide slot to which the first leg portion is fixed, wherein the spring is configured to apply a restoring force to the locking body in a direction in which the second leg portion is moved away from the first leg portion, wherein the first leg portion includes a first extension portion configured to extend downward to be inserted into the guide slot, and wherein the second leg portion includes a second extension portion configured to extend upward to make contact with the locking body.

2. The connector of claim 1, wherein the guide slot is formed with an engagement projection configured to make contact with the first extension portion and to prevent the first leg portion from being separated.

3. The connector of claim 1, wherein the intermediate wall is formed with a support protrusion configured to make contact with a lateral side of the elastic portion and to support the elastic portion.

4. A connector comprising:

a connector body formed with a terminal portion;

a locking body slidably coupled to the connector body; and a spring including a first leg portion fixed in position inside the connector body and a second leg portion making contact with the locking body, wherein the spring is configured to apply a restoring force to the locking body in a direction in which the second leg portion is moved away from the first leg portion, wherein the locking body includes:

a bottom portion having a plate shape;

an intermediate portion formed at an upper side of the bottom portion and protruding more inward than the bottom portion; and a locking protrusion formed at a lower side of the bottom portion, wherein a tip end of the intermediate portion is formed with a separation preventing protrusion configured to make contact with the second leg portion and to prevent separation of the second leg portion.

5. The connector of claim 4, wherein the spring is configured as a torsion spring, and wherein the torsion spring includes an elastic portion that is formed between the first leg portion and the second leg portion and is configured to be wound around an axis corresponding to a height direction of the connector body.

6. The connector of claim 5, wherein the connector body includes:

an upper housing portion configured to accommodate the spring; and a lower housing portion formed at a lower side of the upper housing portion and including the terminal portion disposed therein.

7. The connector of claim 6, wherein the upper housing portion includes an intermediate wall formed with a guide slot to which the first leg portion is fixed.

8. The connector of claim 4, wherein the connector body is formed with a rail groove configured to guide movement of the intermediate portion.

9. A connector assembly comprising:

a first connector including: a connector body formed with a terminal portion; a locking body slidably coupled to the connector body and formed with a locking protrusion; and a spring including a first leg portion fixed in position inside the connector body and a second leg portion making contact with the locking body; and a second connector including a terminal body formed with a contact protrusion which is configured to make contact with the locking protrusion and to move the locking body, wherein the spring is configured to apply a restoring force to the locking body in a direction in which the second leg portion is moved away from the first leg portion.

10. The connector assembly of claim 9, wherein the locking protrusion includes an inclined surface formed so as to face the contact protrusion, and wherein an angle formed between the inclined surf ace and a longitudinal direction of the connector body is 45° or more and 75° or less.

11. The connector assembly of claim 9, wherein the contact protrusion includes:

a curved surface having a convex shape toward the locking protrusion so as to make contact with the locking protrusion; and a contact inclined surface formed so as to incline from a tip end of the curved surface toward an opposite side of the curved surface.

12. The connector assembly of claim 9, wherein both lateral sides of the connector body are formed with guide rails extending along a longitudinal direction of the first connector, respectively, and wherein both lateral sides of the terminal body are formed with guide protrusions configured to be inserted into the guide rails respectively.

13. The connector assembly of claim 9, wherein the terminal body is formed with a fastening protrusion formed at a position spaced apart from the contact protrusion in a diagonal direction of the second connector, and wherein the connector body is formed with a protrusion groove configured such that the fastening protrusion is inserted into the protrusion groove.

14. The connector assembly of claim 13, wherein the first connector is configured to be coupled to the second connector when the fastening protrusion is inserted into the protrusion groove.

15. The connector assembly of claim 9, wherein the second leg portion is configured to approach the first leg portion when the contact protrusion makes contact with the locking protrusion and applies a pushing force to the locking protrusion.

* * * * *